US006715170B2

(12) United States Patent
Richmond

(10) Patent No.: US 6,715,170 B2
(45) Date of Patent: Apr. 6, 2004

(54) STRETCHER

(75) Inventor: Thomas A. Richmond, 7 Titus Ave., Richboro, PA (US) 18954

(73) Assignee: Thomas A. Richmond, Richboro, PA (US)

( * ) Notice: Subject to any disclaimer, the term of this patent is extended or adjusted under 35 U.S.C. 154(b) by 0 days.

(21) Appl. No.: 10/404,814

(22) Filed: Apr. 1, 2003

(65) Prior Publication Data

US 2003/0213066 A1 Nov. 20, 2003

Related U.S. Application Data

(60) Provisional application No. 60/380,715, filed on May 15, 2002.

(51) Int. Cl.[7] ..... A61G 1/00

(52) U.S. Cl. ..... 5/625; 5/626; 5/628; 128/870; 441/129

(58) Field of Search ..... 5/625, 626, 628; 441/83, 125, 129; 128/870

(56) References Cited

U.S. PATENT DOCUMENTS

| | | | | | |
|---|---|---|---|---|---|
| 4,033,000 | A | * | 7/1977 | Bonifay | 5/628 |
| 4,183,110 | A | * | 1/1980 | Kidd et al. | 5/629 |
| 5,190,056 | A | * | 3/1993 | Hull | 5/621 |
| 5,473,784 | A | * | 12/1995 | Nixon et al. | 5/625 |
| 5,749,374 | A | * | 5/1998 | Schneider, Sr. | 128/870 |
| 5,765,243 | A | * | 6/1998 | Duncan et al. | 5/625 |
| 5,950,627 | A | | 9/1999 | Bologovsky et al. | 128/869 |
| 6,073,287 | A | * | 6/2000 | Svensson | 5/625 |
| 6,352,460 | B1 | * | 3/2002 | Eiband et al. | 441/80 |

FOREIGN PATENT DOCUMENTS

| | | | |
|---|---|---|---|
| GB | 2143138 A | * | 2/1985 |
| GB | 2182570 A | * | 5/1987 |

OTHER PUBLICATIONS

Rapid Deployment Products, Inc., http://www.prolitespineboards.com, 33 pages, Undated.

Skedco, Inc., Sked® Basic Rescue System, http://www.emergencynet.com/sked/sk200.htm, 5 pages, 1997.

Product Catalogue from BoundTree Medical Company, 2 pages, Undated.

Product Catalogue from Southeastern Emergency Equipment, pp. 5 and 6, Undated.

* cited by examiner

*Primary Examiner*—Michael F. Trettel
(74) *Attorney, Agent, or Firm*—Woodcock Washburn LLP

(57) ABSTRACT

A stretcher including a substantially rigid cavity defined by a base, opposing ends extending upwardly from the base, and opposing sidewalls disposed between the opposing ends and extending upwardly from the base. Each of the opposing sidewalls includes at least one low section so that a human limb can be extended out of the cavity to maneuver the stretcher.

30 Claims, 7 Drawing Sheets

STRETCHER

RELATED APPLICATION

This application claims the benefit of U.S. Provisional Application No. 60/380,715, filed on May 15, 2002.

FIELD OF THE INVENTION

The present invention relates to portable stretchers that are particularly suited for rescue situations. The stretchers are effective in transporting patients and/or rescuers in environments including water, ice and snow.

SUMMARY OF THE INVENTION

The present invention is directed to stretchers. In accordance with one of the preferred embodiments of the present invention, there has now been provided a stretcher including a substantially rigid cavity for protecting a patient. The cavity is defined by a base, opposing ends extending upwardly from the base, and opposing sidewalls disposed between the opposing ends and extending upwardly from the base. Each of the opposing sidewalls includes at least one low section having an elevation that is less than that of surrounding sections so that a human limb can be extended out of the cavity to maneuver the stretcher.

In accordance with another preferred embodiment of the present invention, there has now been provided a stretcher including a substantially rigid cavity for protecting a patient. The cavity is defined by a base, opposing ends extending upwardly from the base, and opposing sidewalls disposed between the opposing ends and extending upwardly from the base. A pair of runners is disposed on a lower surface of said base. And each of the opposing sidewalls includes a notch so that a human limb can be extended out of the cavity to maneuver the stretcher.

In accordance with yet another preferred embodiment of the present invention, there has now been provided a stretcher including a substantially rigid cavity for protecting a patient. The cavity is defined by a base, opposing ends extending upwardly from the base, and opposing sidewalls disposed between the opposing ends and extending upwardly from the base. A flange extends substantially parallel to the base and outwardly from the sidewalls and ends. The flange includes a plurality of openings extending therethrough.

These and various other features of novelty are pointed out with particularity in the claims annexed hereto and forming a part hereof. However, for a better understanding of aspects of the invention, reference should be made to the drawings which form a further part hereof, and to the accompanying descriptive matter, in which there is illustrated preferred embodiments.

DETAILED DESCRIPTION OF THE PREFERRED EMBODIMENTS

Figure 1:
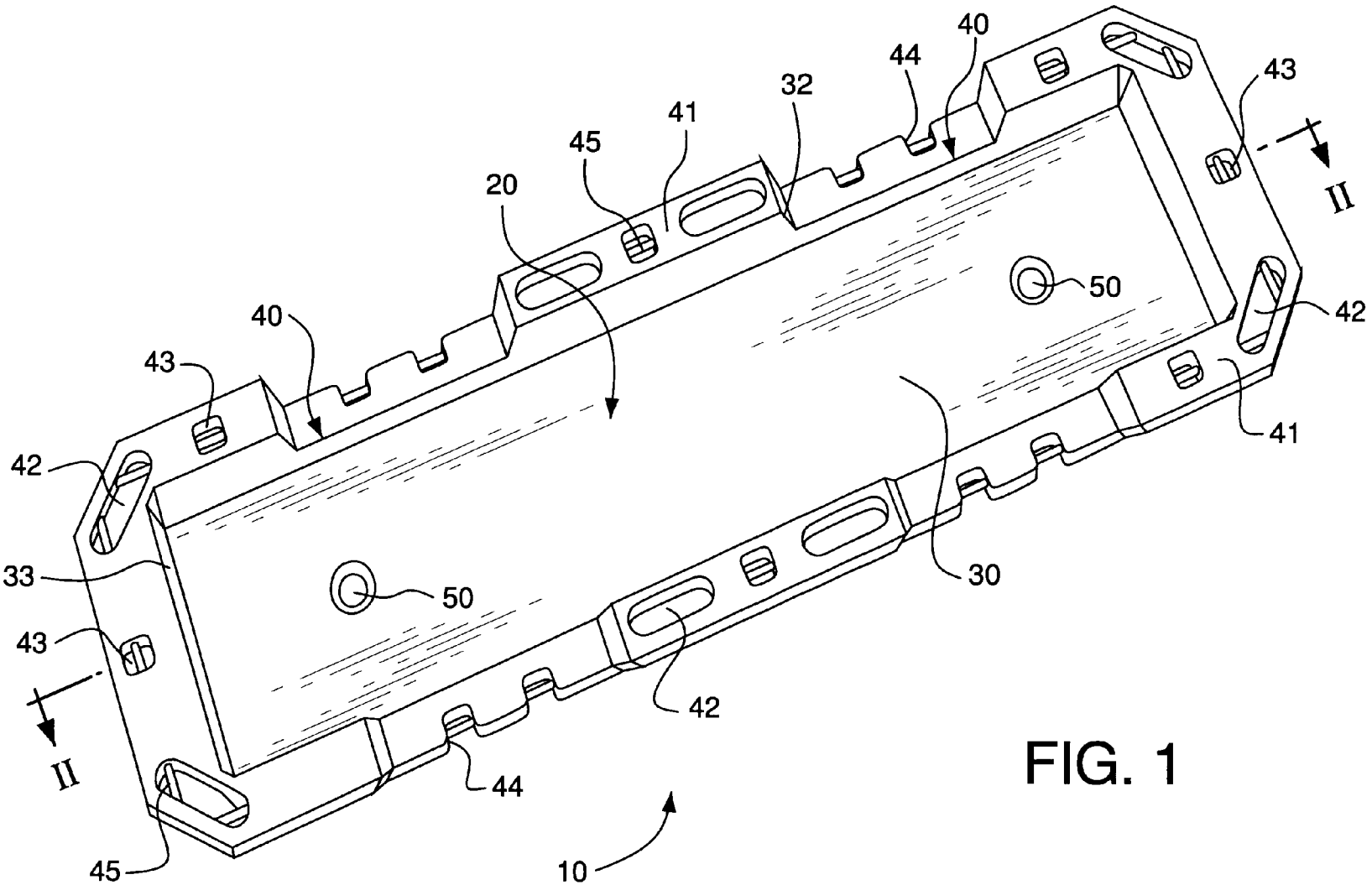
FIG. 1 is a top perspective view of a preferred stretcher embodiment provided by the present invention.
Figure 2:
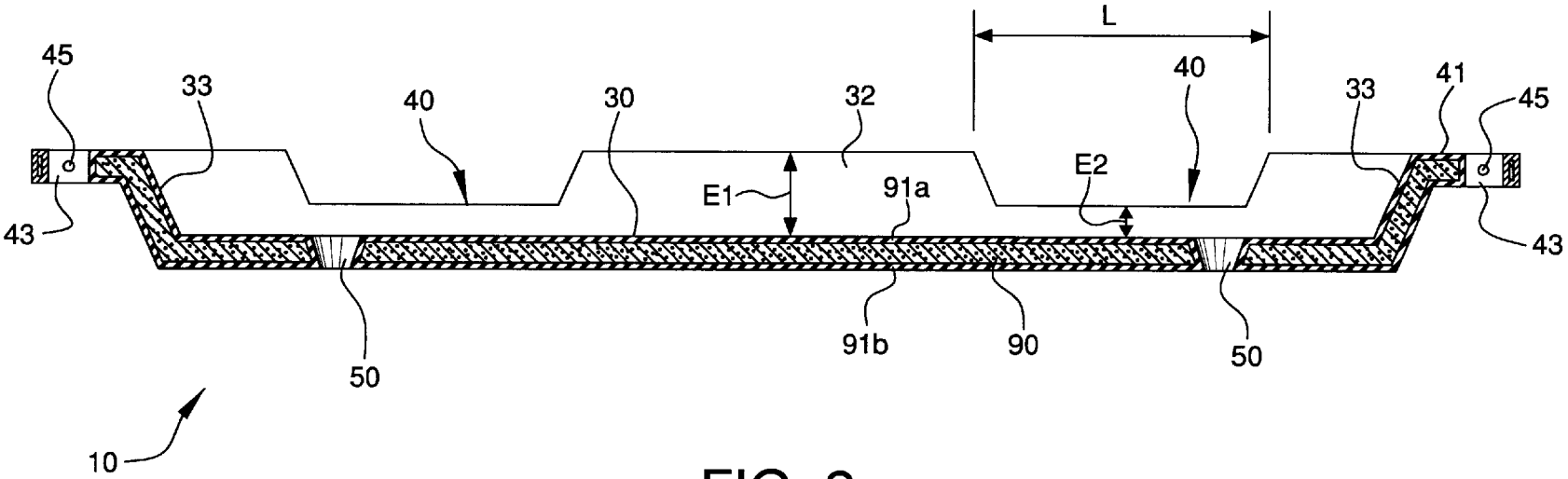
FIG. 2 is a cross-sectional view of the stretcher embodiment shown in FIG. 1 and taken through line II—II.

Referring now to the figures, and in particular to FIGS. 1 and 2, a stretcher 10 is shown including a cavity 20 that is defined by a base 30, opposing sidewalls 32, and opposing ends 33. Cavity 20 and base 30 are designed and configured to accept a patient and/or rescuer directly, or alternatively accept a patient positioned on an immobilization board. By way of example, base 30 preferably has a length dimension from about 50 inches to about 100 inches, and a width dimension from about 15 inches to about 30 inches. Cavity 20 is preferably substantially rigid so that a patient and/or rescuer can be adequately protected during transportation.

Figure 7:
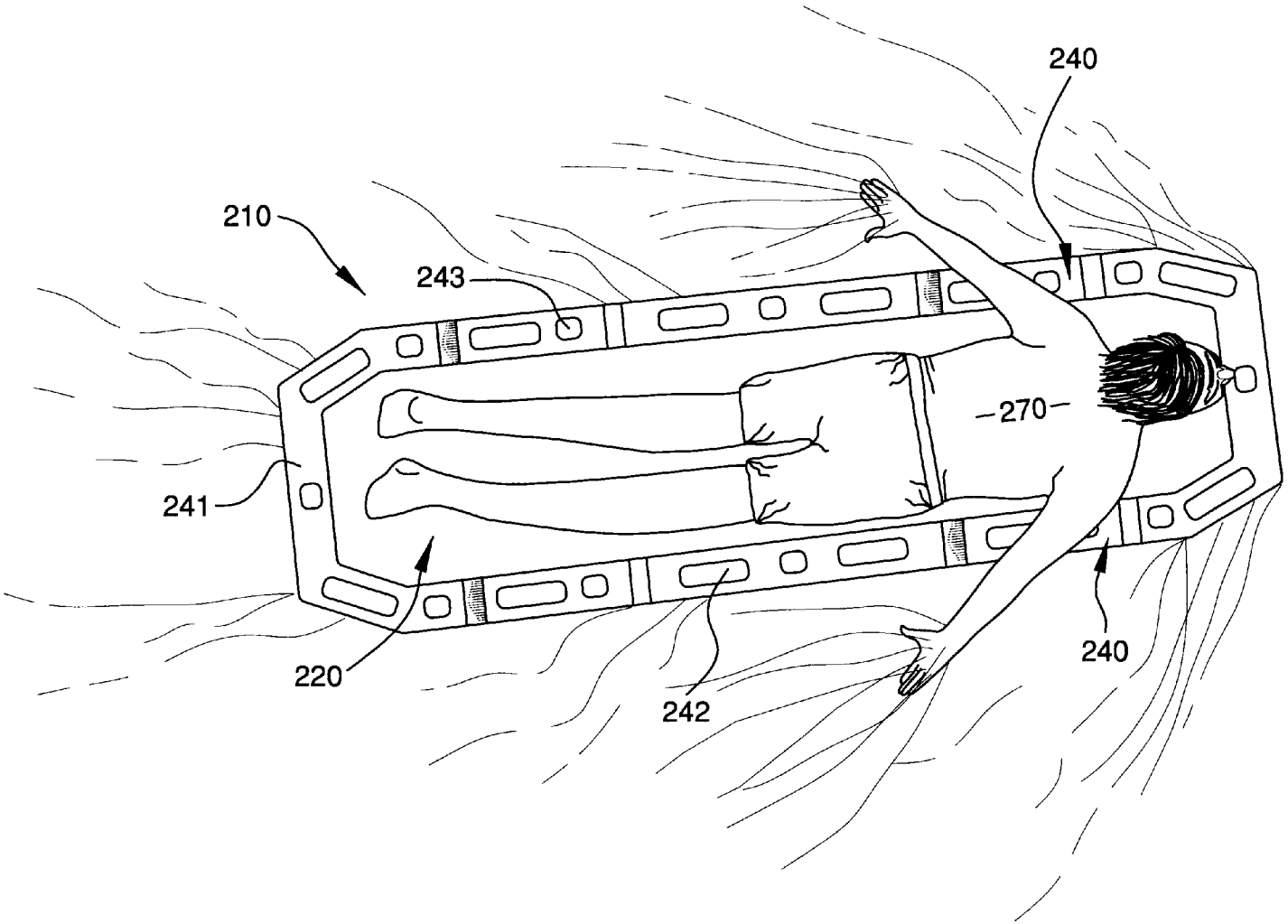
FIG. 7 is a plan view of one of the preferred stretcher embodiments in use.

In preferred stretcher embodiments, opposing sidewalls 32 extend to a varying elevation along their lengths, with low sections that permit a rescuer to extend their arms and/or legs out of cavity 20 to maneuver the stretcher, including propelling, braking and steering the stretcher during search and rescue. For example, in a water rescue, a rescuer can use the stretcher as a flotation aid and paddle out to a victim (as shown in FIG. 7). Similarly, in an ice rescue a rescuer can extend their arms or legs out to pick their way along the ice. The stretcher embodiments shown in the figures show sidewall low sections in the form of notches 40; however, other configurations manifesting low sections are contemplated. As can be seen in FIG. 2, the low sections or notches 40 have an elevation E2 that is preferably from about 1 inch to about 10 inches. The surrounding sections of sidewalls 32 have a relatively higher elevation E1 that is preferably at least one inch greater than elevation E2, and in the range from about 2 inches to about 18 inches. In preferred embodiments, the low sections or notches 40 have a length L in the range of 4 inches to 20 inches. Notches 40 may however be longer than 20 inches in other stretcher embodiments.

Although a single pair of opposing notches 40 is suitable for effectively enabling a rescuer to maneuver the stretcher, two pairs of opposing notches 40 are preferred. When two pairs of opposing notches 40 are employed, the rescuer's arms and legs can both be extended out of the cavity. In addition, two pairs of opposing notches allow a rescuer to-quickly grasp the stretcher without orientation concerns. For example, a rescuer could be positioned in either direction in the cavity and extend their arms out to paddle the stretcher through the water.

Sidewalls 32 and ends 33 are shown having an optional outwardly extending flange 41. Preferably, flange 41 extends substantially parallel to base 30. Flange 41 preferably employs a plurality of openings or cutouts, including hand holes 42, strap holes 43 or cutouts 44. Strap holes 43 and cutouts 44 facilitate the attachment of restraining/securing straps, bridles and the like. Hand holes 42, strap holes 43 and cutouts 44 may optionally contain speed pins 45, which provide quick-release coupling of a strap (or the like) via standard clips. Alternative stretcher embodiments may employ a flange, similar to that shown as flange 41 in the figures, that extends from sidewalls having a uniform elevation (that is, without low sections 40).

Figure 3:
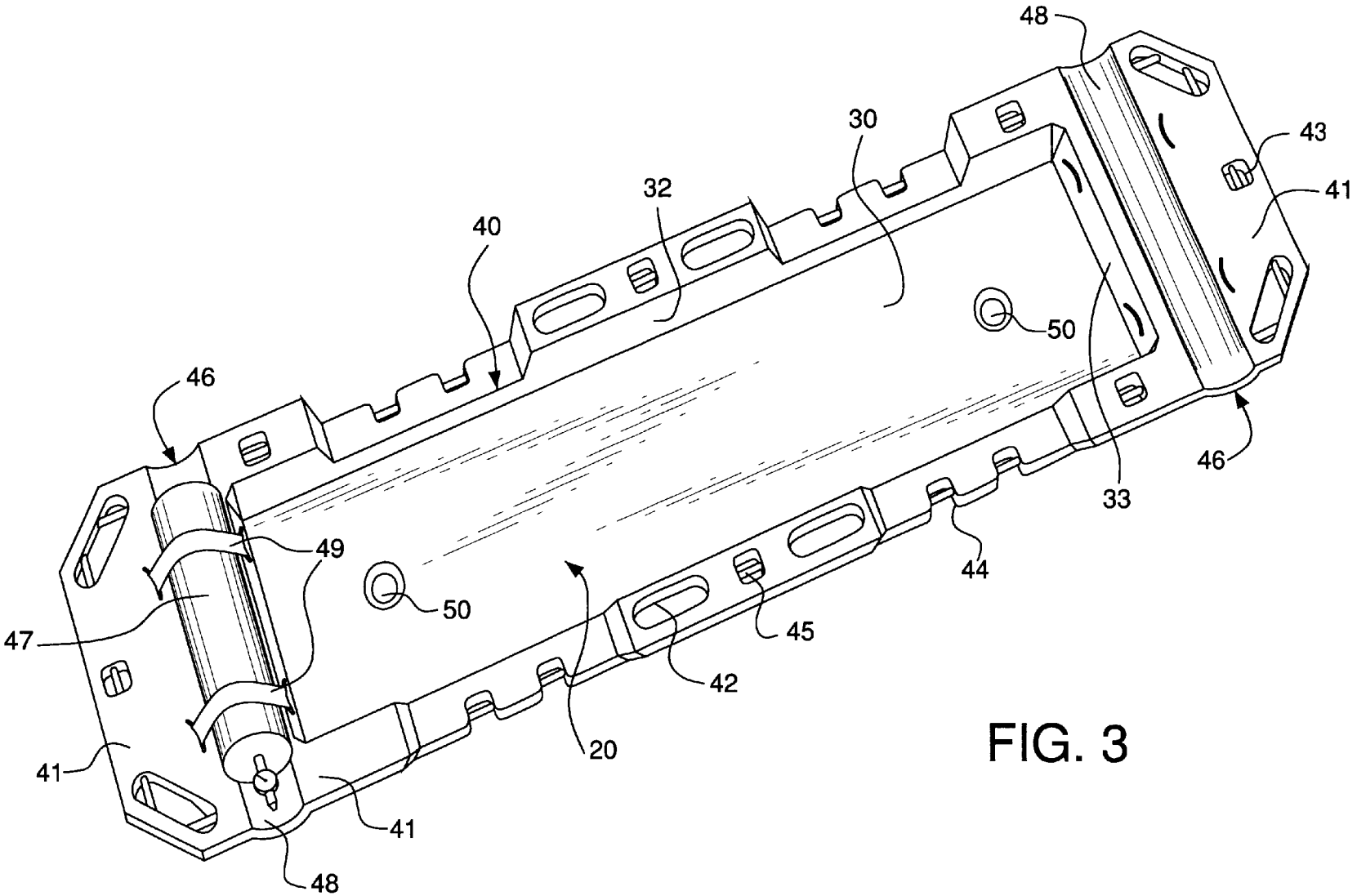
FIG. 3 is a top perspective view of a stretcher embodiment provided by the present invention employing a seat for containing an oxygen bottle or other first-aid equipment.

As is shown in FIG. 3, flange 41 may also include one or more seats 46 for securing an oxygen bottle 47, or other first-aid equipment to the stretcher. A preferred bottle seat includes a concavity 48 formed in a portion of flange 41 and at least one coupling device, such as, for example, a strap 49 to maintain the oxygen bottle's position within the concavity.

Referring to FIGS. 1 and 2, base 30 may include at least one pluggable drain port 50. A plurality of spaced apart ports 50 is preferred. The pluggable drain ports enable stretchers of the present invention to be used for decontaminating a patient. For example, a patient exposed to hazardous material can be "washed" while lying in the stretcher. The runoff can then be safely contained by routing it out of the drain ports 50 and into a hazardous material disposal container. Blood and other bodily fluids can likewise be appropriately handled via the ports when the stretcher is cleaned and sanitized post-use. Drain ports 50 may also be used for introducing materials into the cavity, such as, for example, heated air or medicaments.

Figure 4:
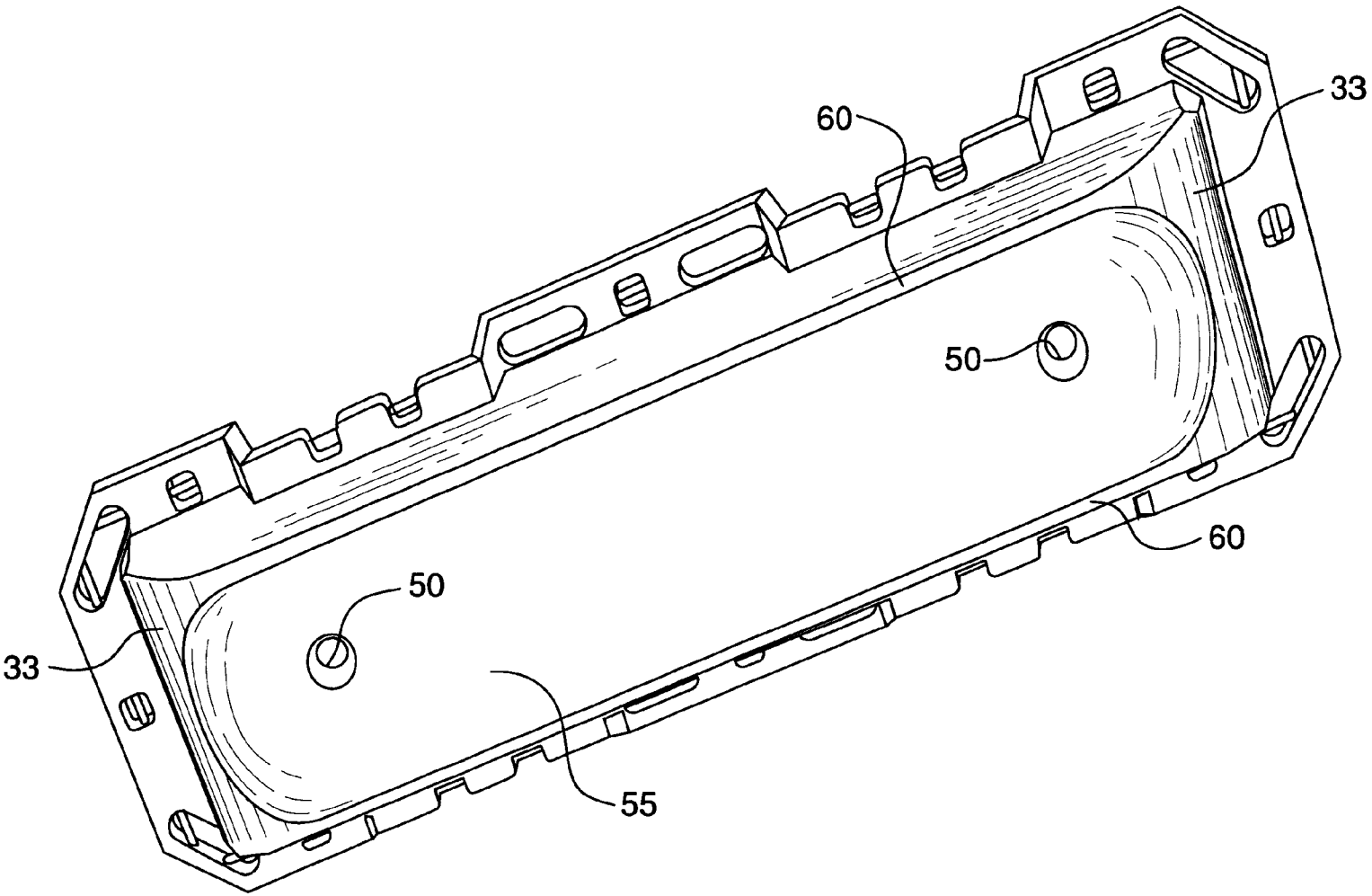
FIG. 4 is bottom perspective view of a preferred stretcher embodiment including a pair of runners, a shaped region between the runners, and angled ends.

Preferred stretcher embodiments of the present invention employ features that promote maneuverability and tracking in water, snow and ice. FIG. 4 shows a cavity lower surface 55 including a pair of runners 60. As illustrated in FIG. 4, the runners can be integrally formed with the stretcher cavity, or alternatively, be manufactured independently and then attached to the stretcher. Stretcher embodiments according to the present invention may also have a shaped lower surface, with or without incorporation of runners. By way of example, the portion of cavity lower surface 55 located between the two runners in FIG. 4 is arcuate-shaped. In addition to the runners and shaped lower surfaces, at least one of opposing ends 33 can be angled or shaped to promote the ability of the stretcher to plow through water or snow.

Figure 5:
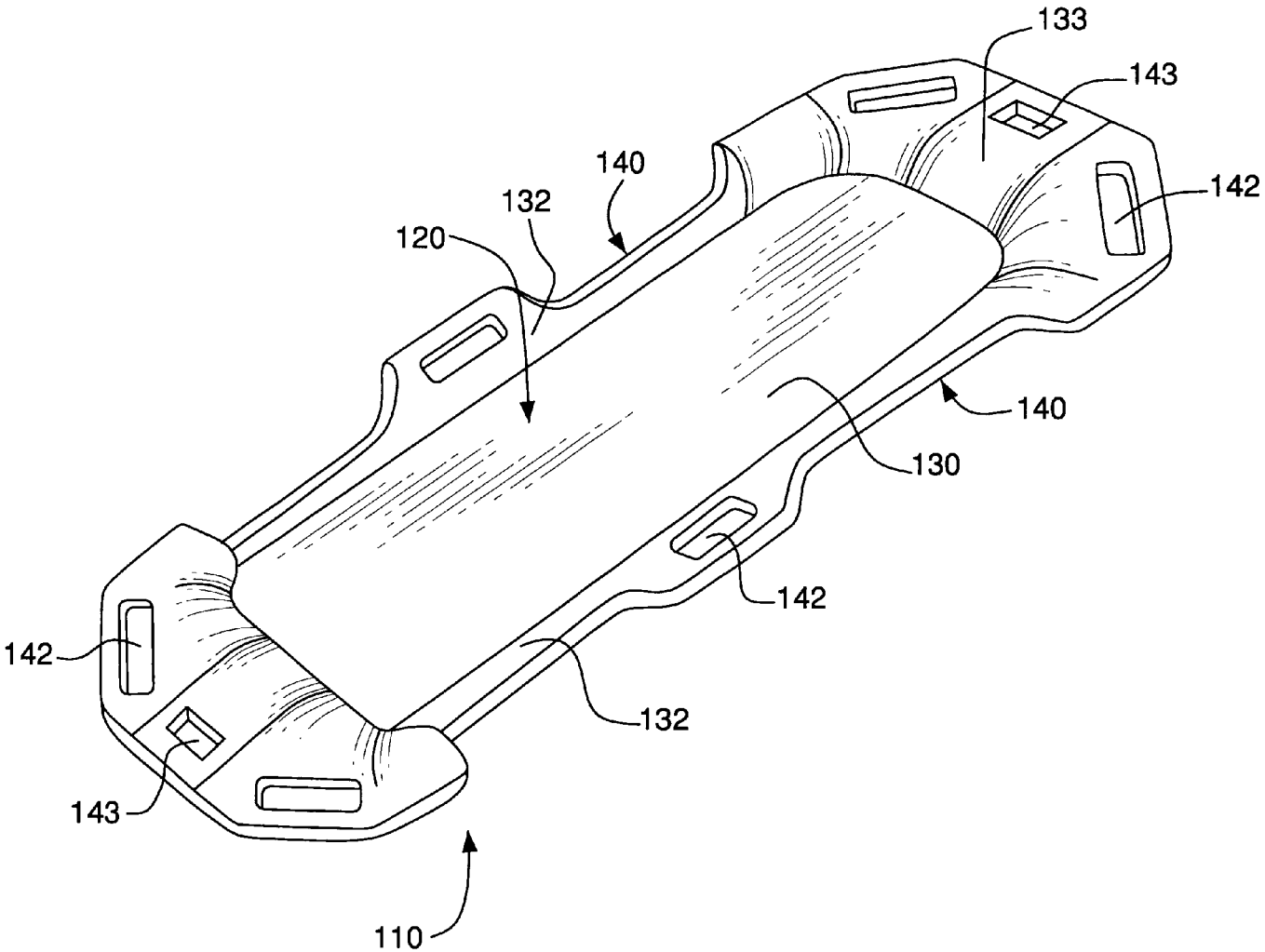
FIG. 5 is a top perspective view of an alternative preferred stretcher embodiment provided by the present invention.
Figure 6:
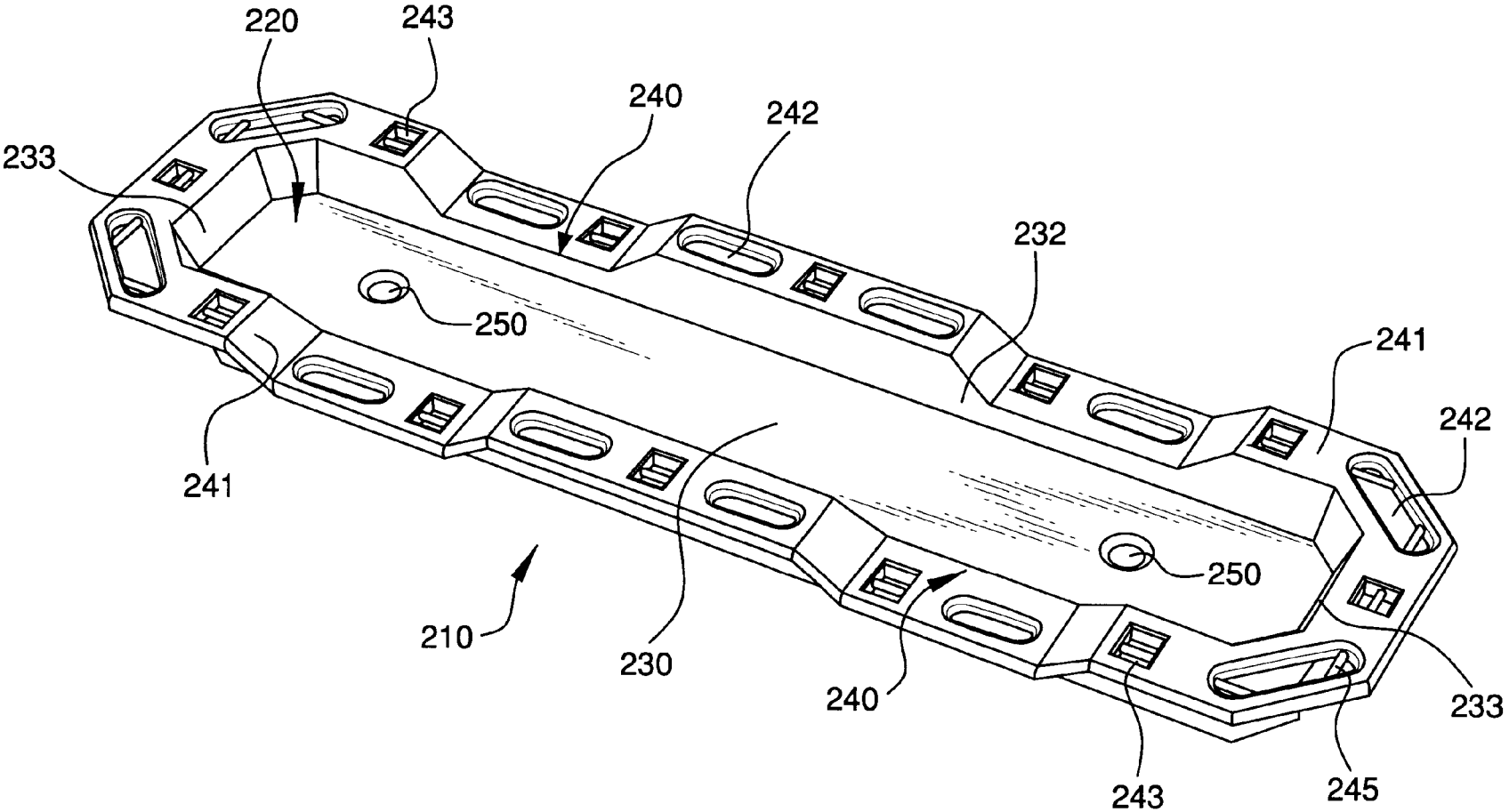
FIG. 6 is a top perspective view of another alternative preferred stretcher embodiment provided by the present invention.

FIGS. 5 and 6 show alternative stretcher embodiments, wherein features as described above are referenced with corresponding numerals in the respective 100 and 200 series. The stretcher sidewalls and ends of the embodiments shown in FIGS. 1–4 are substantially linear and have distinct starting and ending points. Alternative stretcher embodiments are provided, as can be seen in FIG. 5, that more or less have a single continuous wall extending up from the base 130 to define cavity 120. The continuous wall is made up of sidewalls 132 and ends 133, although there are no distinct boundaries and interfaces. FIG. 5 also illustrates that any sidewall, end, or portion thereof, may include curvilinear features. FIG. 7 shows a preferred stretcher embodiment in use, with a rescuer 270 lying in cavity 220 and paddling the stretcher by extending their arms out of cavity 220 via low sections 240.

Stretcher cavities of the present invention can be manufactured from many different materials, including but not limited to, polymers, metals, composites, foams, fiberglass, wood, KEVLAR, coated paperboard, and combinations thereof. Preferably, the stretcher is made from a material comprising a polymer, such as, for example high-density polyethylene. Any known techniques for forming three-dimensional structures from the list of materials above can be employed for manufacturing the stretcher components.

In preferred embodiments, the cavity is injection molded or rotational molded. Utilizing a rotational molding technique can yield a hollow double-wall configuration. As is shown in FIG. 2, filler material 90 may be disposed between first wall 91*a* and second wall 91*b* to impart added strength, and insulation and flotation properties. A representative, non-limiting list of filler material includes air, foam, natural and synthetic fibers, and wood products. Preferably, the filler material is a liquid foam, such as catalyzed urethane foam, that is injected into the double-wall configuration with techniques such as reaction injection molding.

Design features, materials, and manufacturing techniques as described above may be selectively combined to provide various beneficial properties, such as, for example, x-ray translucency and floatation. Stretchers of the present invention are preferably floatable without a load, more preferably floatable with a load of about 200 pounds residing in the cavity, and most preferably floatable containing a load of up to about 350 pounds, all in the absence of retrofitted (additional) flotation aids.

It is to be understood that even though numerous characteristics and advantages of the present invention have been set forth in the foregoing description, together with details of the structure, manufacture of, and function of the invention, the disclosure is illustrative only. Accordingly, changes may be made in detail, especially in matters of shape, size and arrangement of structural features, as well as, sequences of manufacturing steps, within the principles of the invention to the full extent indicated by the broad general meaning of the terms in which the appended claims are expressed.

What is claimed is:

1. A stretcher comprising:

a substantially rigid cavity for protecting a patient, the cavity defined by a base, opposing ends extending upwardly from said base, and opposing sidewalls disposed between said opposing ends and extending upwardly from said base;

wherein each of said opposing sidewalls includes at least one low section having an elevation that is less than that of surrounding sections so that a human limb can be extended out of said cavity to maneuver the stretcher.

2. The stretcher of claim 1, wherein said at least one low section is a notch.

3. The stretcher of claim 2, wherein each of said sidewalls includes two spaced apart notches.

4. The stretcher of claim 1, further comprising a pair of runners disposed on a lower surface of said cavity.

5. The stretcher of claim 4, wherein said cavity and said pair of runners are integrally formed.

6. The stretcher of claim 4, wherein a portion of said lower surface residing between said pair of runners is arcuate-shaped.

7. The stretcher of claim 1, wherein at least one of said opposing ends is angled.

8. The stretcher of claim 1, wherein at least one of said opposing sidewalls and said opposing ends comprises an outwardly extending flange that is substantially parallel to said base.

9. The stretcher of claim 8, wherein said flange includes a plurality of openings or cutouts.

10. The stretcher of claim 9, wherein said plurality of openings or cutouts includes a hand hold.

11. The stretcher of claim 9, wherein at least some of said plurality of openings or cutouts includes a pin spanning a portion thereof for attaching a bridle or securing strap to the stretcher.

12. The stretcher of claim 8, wherein said flange includes a bottle seat.

13. The stretcher of claim 1, wherein said base comprises at least one pluggable drain port extending therethrough.

14. The stretcher of claim 1, wherein said cavity is sized and configured to accept an immobilization board.

15. The stretcher of claim 1, wherein said cavity is formed having a double-wall configuration with filler material therebetween.

16. The stretcher of claim 15, wherein said filler material includes foam.

17. The stretcher of claim 1, wherein said cavity is formed by a manufacturing method including rotational molding.

18. The stretcher of claim 1, wherein said cavity is formed from a material including a polymer.

19. The stretcher of claim 18, wherein said polymer includes a high-density polyethylene.

20. The stretcher of claim 1, wherein said cavity is x-ray translucent.

21. A stretcher comprising:

a substantially rigid cavity for protecting a patient, the cavity defined by a base, opposing ends extending upwardly from said base, and opposing sidewalls disposed between said opposing ends and extending upwardly from said base; and a pair of runners disposed on a lower surface of said base;

wherein each of said opposing sidewalls includes a notch so that a human limb can be extended out of said cavity to maneuver the stretcher.

22. The stretcher of claim 21, wherein said cavity and said pair of runners are integrally formed.

23. The stretcher of claim 21, wherein said cavity is having a double-wall configuration with a filler material therebetween.

24. The stretcher of claim 21, wherein at least one of said opposing sidewalls and said opposing ends comprises an outwardly extending flange that is substantially parallel to said base.

25. The stretcher of claim 24, wherein said flange includes a bottle seat.

26. The stretcher of claim 21, wherein at least one of said opposing ends is angled.

27. The stretcher of claim 21, wherein a portion of said lower surface residing between said pair of runners is arcuate-shaped.

28. The stretcher of claim 21, wherein said base comprises at least one pluggable drain port extending therethrough.

29. A stretcher comprising:

a substantially rigid cavity for protecting a patient, the cavity defined by a base, opposing ends extending upwardly from said base, and opposing sidewalls disposed between said opposing ends and extending upwardly from said base;

a flange extending substantially parallel to said base and outwardly from said opposing sidewalls and said opposing ends; and a plurality of openings extending through said flange.

30. The stretcher of claim 29, further comprising a notch formed in each of said opposing sidewalls so that a human limb can be extended out of said cavity to maneuver the stretcher.

* * * * *